US011364533B2

(12) United States Patent
Kim et al.

(10) Patent No.: US 11,364,533 B2
(45) Date of Patent: Jun. 21, 2022

(54) TRANSFER PRESSING APPARATUS AND METHOD

(71) Applicant: Sewon Precision Industry Co., Ltd., Daegu (KR)

(72) Inventors: Moon Ki Kim, Daegu (KR); Sang Hyun Kim, Daegu (KR)

( * ) Notice: Subject to any disclaimer, the term of this patent is extended or adjusted under 35 U.S.C. 154(b) by 189 days.

(21) Appl. No.: 16/833,514

(22) Filed: Mar. 28, 2020

(65) Prior Publication Data

US 2021/0299733 A1 Sep. 30, 2021

(51) Int. Cl.

| | |
|---|---|
| ***B21D 43/02*** | (2006.01) |
| ***B21D 28/00*** | (2006.01) |
| ***B21C 47/24*** | (2006.01) |
| ***B21C 47/18*** | (2006.01) |
| *B21B 15/00* | (2006.01) |

(52) U.S. Cl.

CPC ..... *B21D 43/02* (2013.01); *B21C 47/18* (2013.01); *B21C 47/24* (2013.01); *B21D 28/00* (2013.01); *B21B 2015/0014* (2013.01); *B21B 2015/0064* (2013.01)

(58) Field of Classification Search

CPC .... B21D 43/02; B21D 43/021; B21D 43/026; B21C 47/18; B21C 47/24; B21C 47/3433; B65H 16/00; B21B 2015/0014; B21B 2015/0064

See application file for complete search history.

(56) References Cited

U.S. PATENT DOCUMENTS

| | | | | | |
|---|---|---|---|---|---|
| 2,756,943 | A * | 7/1956 | Sieger | B21C 47/24 | 242/561 |
| 3,461,703 | A * | 8/1969 | Ranney | B21C 47/3433 | 242/562 |
| 4,608,844 | A * | 9/1986 | Lehmann | B05C 1/083 | 242/562 |
| 6,691,544 | B2 * | 2/2004 | Steudle | B65H 16/04 | 72/183 |
| 10,576,521 | B2 * | 3/2020 | Tokunaga | B21B 37/68 | |
| 2004/0079780 | A1 * | 4/2004 | Kato | B21D 43/022 | 226/24 |
| 2014/0202225 | A1 * | 7/2014 | Runyan | B21D 43/02 | 72/372 |

FOREIGN PATENT DOCUMENTS

| | | | | |
|---|---|---|---|---|
| DE | 2607938 | A1 * | 9/1977 | B21C 47/34 |
| DE | 2835476 | A1 * | 1/1980 | B21C 47/18 |
| JP | 59-202118 | A * | 11/1984 | B21C 47/16 |
| KR | 10-1995-0000255 | | 1/1995 | |
| KR | 20-1995-0003202 | | 2/1995 | |
| KR | 20-1996-0020728 | | 7/1996 | |
| KR | 20-1999-0026125 | | 7/1999 | |

OTHER PUBLICATIONS

English Specification of 10-1995-0000255.
English Specification of 20-1995-0003202.
English Specification of 20-1996-0020728
English Specification of 20-1999-0026125.

* cited by examiner

*Primary Examiner* — Edward T Tolan
(74) *Attorney, Agent, or Firm* — Antonio Ha & U.S. Patent, LLC

(57) ABSTRACT

Embodiments of the disclosure relate to a transfer pressing apparatus and method for forming car body parts, and more specifically, to a transfer pressing apparatus and method capable of automatically producing car body parts using rolled coils.

7 Claims, 7 Drawing Sheets

TRANSFER PRESSING APPARATUS AND METHOD

TECHNICAL FIELD

Embodiments of the disclosure relate to a transfer pressing apparatus and method for forming car body parts, and more specifically, to a transfer pressing apparatus and method capable of automatically producing car body parts using rolled coils.

DISCUSSION OF RELATED ART

Car body parts are typically formed by pressing metal sheets for rigidity.

Various pieces of equipment, such as feeders and shearers as well as presses, may be used in combination to form car body parts.

For example, a rolled coil is cut into a board with a unit size, and the board is moved to a press for press-pressing into a car body part. The car body part is loaded out.

This way is currently a typical one adopted by car part manufacturers.

However, this way requires many pieces of equipment to be separately purchased and used in combination, consuming much installation space and resultantly increasing the foot print.

Further, workers are allocated to each piece of equipment for manual processing. This way deteriorates working efficiency and productivity due to an increase in tact time. Thus, a need exists for a brand-new pressing apparatus automated to produce car body parts in an efficient manner.

SUMMARY

According to an embodiment, there is provided a transfer pressing apparatus and method capable of automatically producing car body parts using rolled coils.

According to an embodiment, a transfer pressing apparatus for forming a car body part comprises a coil feeder rotatably supporting a rolled coil and supplying the coil to a processing line by rotation, and a shearer disposed downstream of the coil feeder and cutting the coil supplied to the processing line into unit sizes, wherein the coil feeder includes a coil mount on which the coil is rotatably mounted, a rotation driver connected with the coil mount and rotating the coil mount, a guide arm disposed around the coil mount and guiding the coil released while rotating on the coil mount, an arm driver driving the guide arm to allow the guide arm to contact the coil, a coil exchanger including a coil loader for loading the coil and a forward/backward driver moving forward or backward the coil loader, the coil exchanger disposed around the coil mount, the coil exchanger moving close to or away from the coil mount while transferring the coil to the coil mount and exchanging the coil, a coil mover disposed between the shearer and the coil mount and moving the coil released from the coil mount to the shearer, a plurality of flattening rollers disposed between the coil mover and the shearer and flattening the coil, a coil back end chuck disposed between the flattening rollers and the coil mover and chucking a back end of the coil, and a coil front end chuck disposed between the flattening rollers and the shearer and chucking a front end of the coil.

The coil feeder includes a fixed lower guide disposed between the coil mount and the coil mover and guiding the coil to the coil mover, and a rotational upper guide disposed over the fixed lower guide and, together with the fixed lower guide, guiding the coil.

The coil feeder includes a guide actuator connected with the rotational upper guide and rotationally driving the rotational upper guide, and a board centerer movably disposed around a transferrer and centering a board loaded on a base mold.

The transfer pressing apparatus further comprises a plurality of loaders on which a board cut into a unit size by the shearer are loaded, an articulated robot disposed around the plurality of loaders and handling the board on the loaders, and the transferrer disposed adjacent to the articulated robot and supplying the board downstream.

The transfer pressing apparatus further comprises a press disposed downstream of the transferrer and pressing the board transferred by the transferrer into a car body part.

The press includes a base mold on which the board is placed, a press mold disposed over the base mold, a mold up/down driver connected with the press mold and moving up/down the press mold, and a moving aligning bar including a plurality of aligners disposed around the base mold to be movable to the base mold and aligning the board loaded on the base mold to a position for pressing.

The transfer pressing apparatus further comprises a discharger disposed downstream of the press and discharging the car body part.

The transfer pressing apparatus further comprises a controller configured to automatically control operations of the coil feeder, the shearer, the articulated robot, the transferrer, the press, the discharger, the guide actuator, and the board centerer.

The transfer pressing apparatus further comprises an error lamp controlled by the controller to visually output an error in a transfer pressing process for forming the car body part, and an error buzzer controlled to be operated along with the error lamp by the controller to audibly output the error.

The transfer pressing apparatus further comprises a power stopping device operated in association with the controller, wherein the controller controls the power stopping device to automatically stop power when controlling to provide a notification signal to the error lamp and the error buzzer.

According to an embodiment, a method of transfer pressing for forming a car body part comprises supplying a rolled coil to a processing line by rotation, cutting the coil supplied to the processing line, and loading a board cut to a unit size by the cutting.

The method further comprises supplying the loaded board downstream by an articulated robot, pressing the supplied board into a car body part, and discharging the car body part.

The transfer pressing apparatus and method for forming car body parts, according to embodiments, may automatically produce car body parts using rolled coils in a compact and more efficient manner, thus increasing working speed and productivity.

According to an embodiment, the apparatus is compact, thus significantly reducing space for installation and thus foot print. Further, unlike in the prior art, manual work may be significantly reduced, and working efficiency may be enhanced. Further, the tact time may be decreased.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
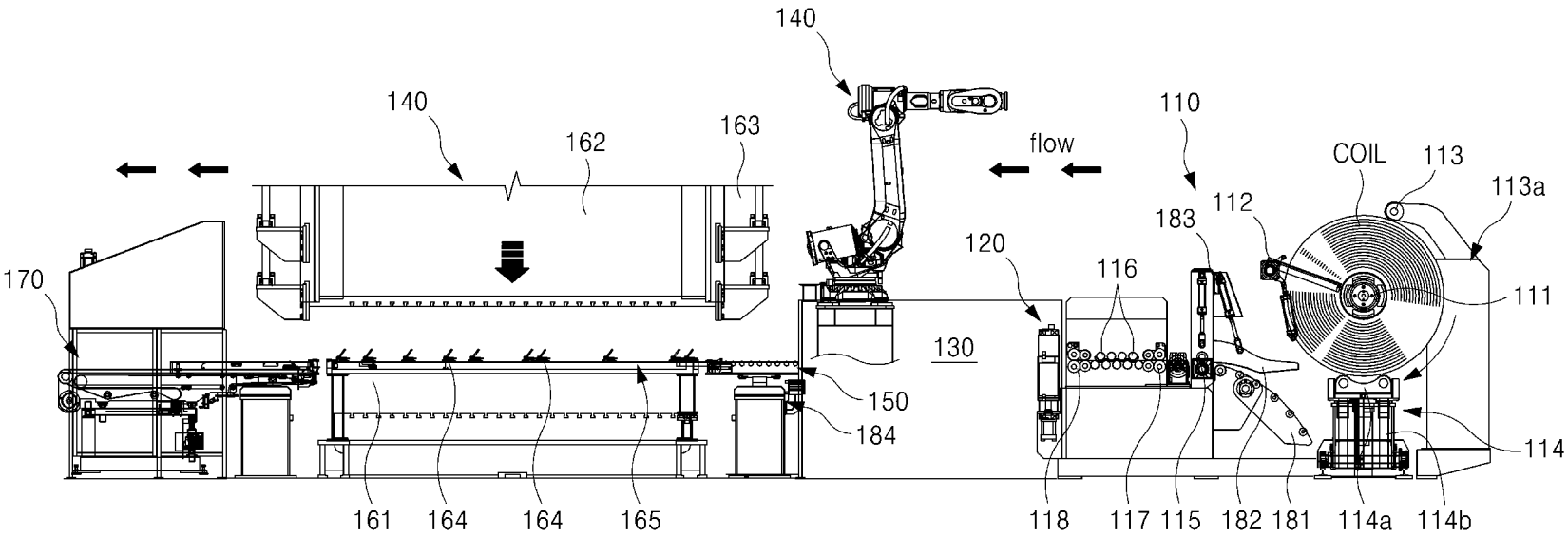
FIG. 1 is a view illustrating a configuration of a transfer pressing apparatus for forming car body parts according to an embodiment.

Advantages and features of the present disclosure, and methods for achieving the same may be understood through the embodiments to be described below taken in conjunction with the accompanying drawings.

However, the scope of the disclosure is not limited to embodiments described herein, but rather, other various changes may be made thereto.

However, the present disclosure is not limited to the embodiments disclosed herein, and various changes may be made thereto. The embodiments disclosed herein are provided only to inform one of ordinary skilled in the art of the category of the present disclosure. The present disclosure is defined only by the appended claims.

The scope of the disclosure is defined by the appended claims.

In some embodiments, known components, operations, and techniques are not described in detail to avoid the disclosure from ambiguity in interpretation.

The same reference numeral denotes the same element throughout the specification.

The terms as used herein are provided merely to describe some embodiments thereof, but not intended as limiting the present disclosure.

As used herein, the singular forms "a," "an," and "the" are intended to include the plural forms as well, unless the context clearly indicates otherwise.

As used herein, the term "comprises" and/or "comprising" does not exclude the presence or addition of one or more other components, steps, operations, and/or elements than the component, step, operation, and/or element already mentioned.

Unless defined otherwise, all the terms (including technical and scientific terms) used herein may be construed as commonly appreciated by one of ordinary skill in the art to which the present disclosure pertains.

Further, terms defined in a dictionary commonly used are not ideally or overly interpreted unless defined expressly or specifically.

Hereinafter, embodiments of the present disclosure are described in detail with reference to the accompanying drawings.

Figure 2:
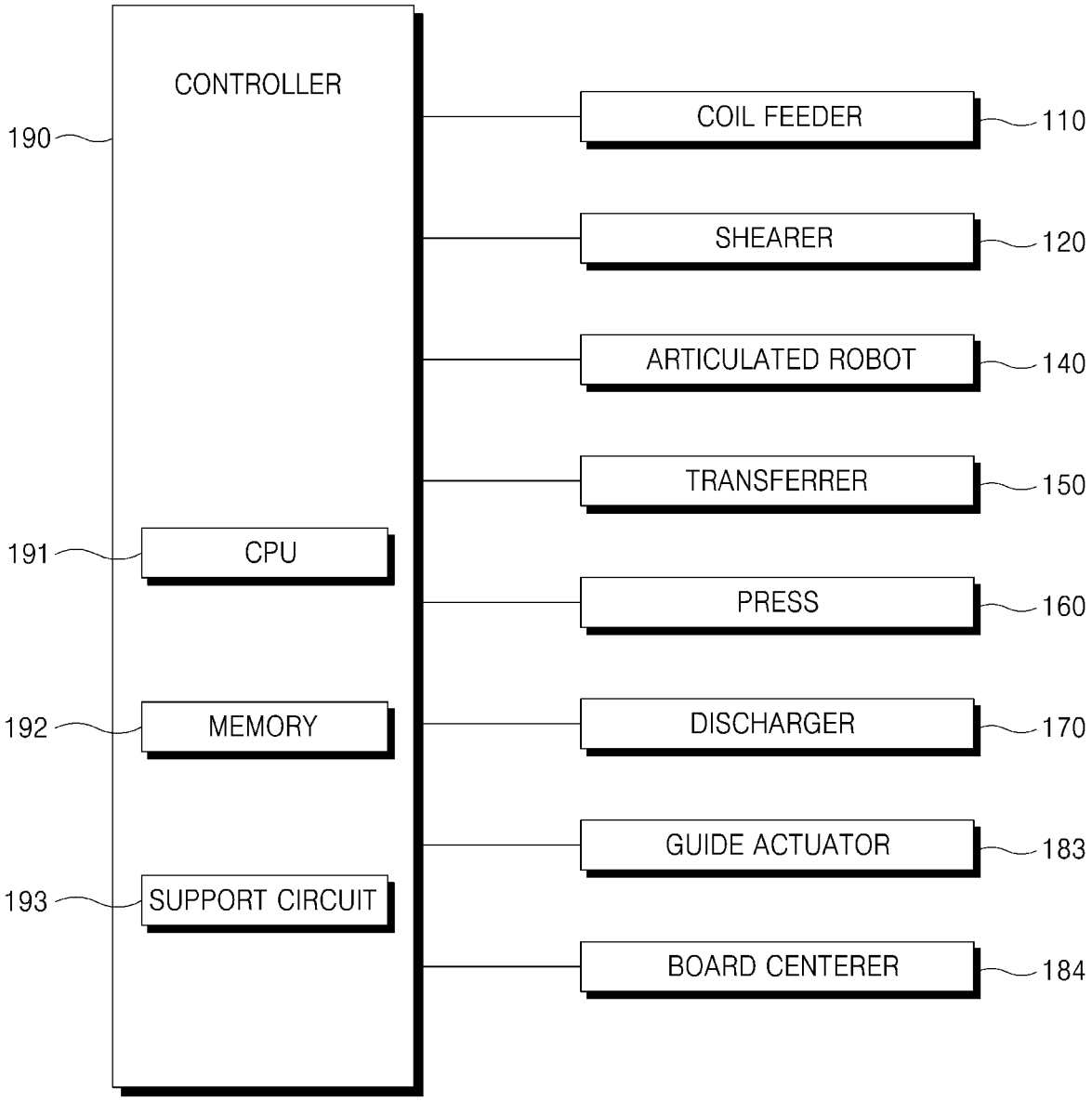
FIG. 2 is a block diagram illustrating a transfer pressing apparatus for forming car body parts as shown in FIG. 1.
Figure 3:
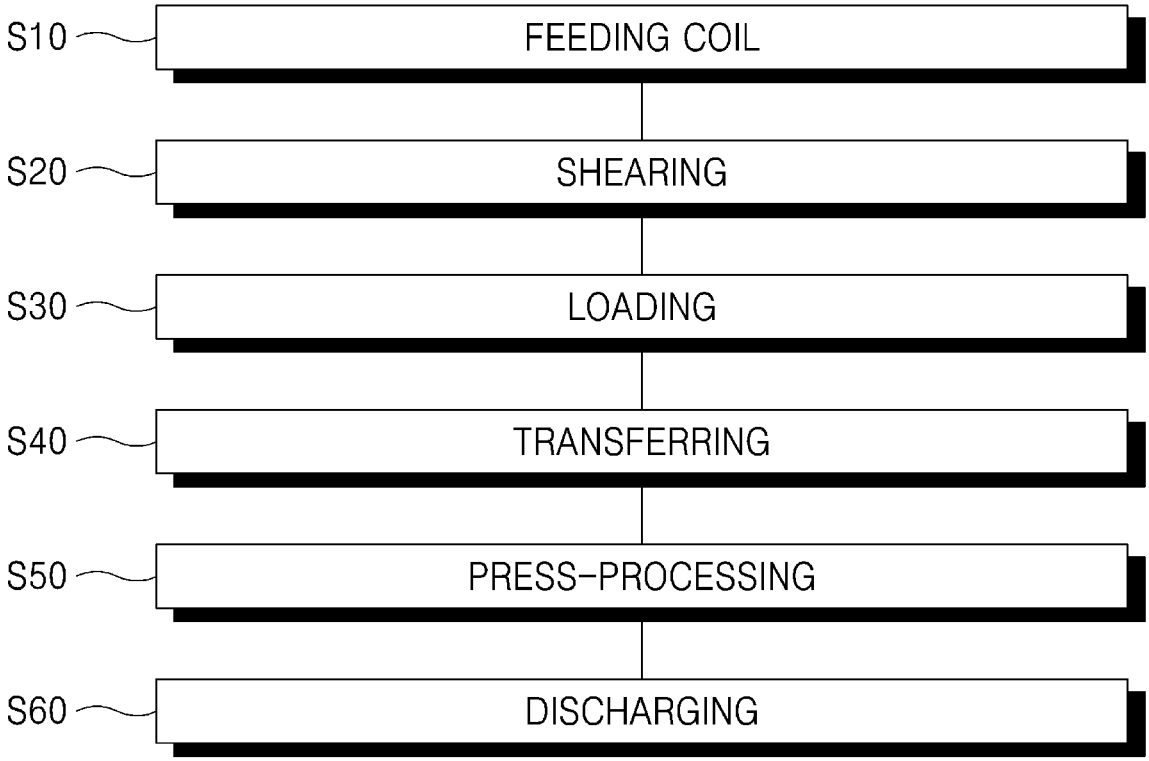
FIG. 3 is a flowchart illustrating a method of transfer pressing for forming a car body part according to an embodiment.

FIG. 1 is a view illustrating a configuration of a transfer pressing apparatus for forming car body parts according to an embodiment. FIG. 2 is a block diagram illustrating a transfer pressing apparatus for forming car body parts as shown in FIG. 1. FIG. 3 is a flowchart illustrating a method of transfer pressing for forming a car body part according to an embodiment.

The transfer pressing apparatus and method for forming car body parts, according to embodiments, may automatically produce car body parts using rolled coils in a compact and more efficient manner, thus increasing working speed and productivity.

According to an embodiment, a rolled coil is flattened and then cut to a board with a unit size, and the board is pressed into a car body part.

The car body part may be formed in one of various shapes applicable in various positions of the car, and its specific shape is not illustrated.

However, it is appreciated by one of ordinary skill in the art that any product that may be produced by press-processing a flat board or plate belongs to the scope of the disclosure.

Referring to FIG. 1, according to an embodiment, a transfer pressing apparatus for forming car body parts may include a coil feeder 110, a shearer 120, a loader 130, an articulated robot 140, a transferrer 150, a press 160, a discharger 170, and a controller 190 for controlling them.

The coil feeder 110 rotatably supports a rolled coil and supplies the coil to the processing line by rotation.

The processing line refers to a line of processes performed after the coil feeder 110.

The coil feeder 110 may include a coil mount 111, a rotation driver 112, a guide arm 113, a coil exchanger 114, a coil mover 115, a flattening roller 116, a coil back end chuck 117, and a coil front end chuck 118.

Each component of the coil feeder 110 is described.

The coil mount 111 is a component on which the coil is rotatably mounted.

The center of the coil may be rotatably mounted on the coil mount 111.

The coil feeder 110 includes the coil exchanger 114 to allow the coil to be mounted and exchanged easily.

The coil exchanger 114 is disposed around the coil mount 111, approaches or moves away from the coil mount 111 while transferring the coil to the coil mount 111 and exchanging the coils.

The coil exchanger 114 may include a foil loader **114*a* on which the coil is loaded and a forward/backward driver 114*b* for moving forward or backward the coil loader 114*a***.

Since the coil is very heavy, the coil may be loaded up on the coil loader **114*a* and moved to the position of exchange by the forward/backward driver 114*b***, and then exchange of coils may be performed by, e.g., a crane.

The rotation driver 112 is connected with the coil mount 111 and rotates the coil mount 111.

The rotation driver 112 may include a cylinder structure and/or motor structure.

No detailed illustration of the rotation driver 112 is given.

The guide arm 113 is disposed around the coil mount 111 to guide the coil released from the coil mount 111 while rotating.

An arm driver **113*a* is connected to the guide arm 113 to drive the guide arm 113** to contact the coil.

If the guide arm 113 guides the coil released from the coil mount 111, stable release of the coil and safe work may be expected or implemented.

The coil mover 115 is disposed between the shearer 120 and the coil mount 111 and moves the coil released from the coil mount 111 to the shearer 120.

Thus, a power device may be connected to the coil mover 115.

The flattening roller 116 is disposed between the coil mover 115 and the shearer 120 and flattens the coil towards the shearer 120.

There may be provided a plurality of flattening rollers 116 spaced apart from each other.

As shown in FIG. 1, a plurality of flattening rollers 116 may be disposed one over another, and the coil may be flattened while passing through between the upper rollers and lower rollers.

The coil back end chuck 117 is disposed between the flattening rollers 116 and the coil mover 115 and holds the back end of the moving coil.

The coil front end chuck 118 is disposed between the flattening rollers 116 and the shearer 120 and holds the front end of the moving coil.

When the shearer 120 operates, the coil front end chuck 118 and the coil rear end chuck 117 sequentially hold the coil.

Thus, the coil may be cut in place.

The coil back end chuck 117 and the coil front end chuck 118 may be excluded from the components, which case should also be appreciated as belonging to the scope of the disclosure.

A fixed lower guide 181, a rotational upper guide 182, and a guide actuator 183 may be arranged around the coil mover 115.

The fixed lower guide 181 is disposed between the coil mount 111 and the coil mover 115 and guides the coil moving towards the coil mover 115. The rotational upper guide 182 is disposed over the fixed lower guide 181 and, along with the fixed lower guide 181, guides the coil.

The guide actuator 183 is connected with the rotational upper guide 182 and rotates the rotational upper guide 182.

Since the rotational upper guide 182 may be rotated by the guide actuator 183, the rotational upper guide 182, together with the fixed lower guide 181, may properly guide the released coil to the later processes.

The shearer 120 is disposed downstream of the coil feeder 110 and cuts the coil supplied to the processing line to a unit size.

The coil may be bent by the shearer 120. According to an embodiment, the shearer 120 may cut the seamless and continuous coil into unit sizes.

The coil is cut into a board with predetermined horizontal/vertical sizes while passing through the shearer 120.

The loader 130 has the boards cut into by the shearer 120 loaded thereon.

Since pressing may take longer than shearing, the loader 130 may be provided.

Preferably, there may be provided a plurality of loaders 130.

The articulated robot 140 is disposed around the plurality of loaders 130 and handles the board on the loader 130, i.e., providing the board to the transferrer 150.

Alternatively, instead of the articulated robot 140, other corresponding components, e.g., a conveyor system, may be used.

The transferrer 150 may be disposed adjacent to, neighboring, or next to the articulated robot 140 and supplies the board to the press 160 which performs the later processes, e.g., substantial forming into a car body part.

A board centerer 184 may be provided around the transferrer 150.

The board centerer 184 may be movably disposed around the transferrer 150 and centers the board loaded on the base mold 161.

The use of the board centerer 184 allows the board to be positioned in place and supplied to the press 160, thereby enhancing the quality of pressed product.

The press 160 is disposed downstream of the transferrer 150 and press-processes (or forms) the board from the transferrer 150 into a car body part.

The press 160 may include a base mold 161 on which the board is placed, a press mold 162 disposed over the base mold 161, a mold up/down driver 163 connected with the press mold 162 to move up or down the press mold 162, and a moving align bar 165.

The moving align bar 165 includes a plurality of aligners 164 that are arranged around the base mold 161 and are provided to be movable to the base mold 161 and that align the board loaded on the base mold 161 to a proper position.

For example, as the moving align bar 165 moves to the base mold 161, the plurality of aligners 164 may align the board to a proper position. Thus, the press mold 162 may pressurize the board in place, thus allowing for better quality of product.

The discharger 170 is disposed downstream of the press 160 and provides a space where the pressed car body part is discharged.

The controller 190 may automatically control the operation of the coil feeder 110, shearer 120, articulated robot 140, transferrer 150, press 160, discharger 170, guide actuator 183, and board centerer 184.

The controller 190 may include a central processing unit (CPU) 191, a memory 192, and a support circuit 193.

According to an embodiment, the CPU 191 may be one of various computer processors industrially applicable to automatically control the operation of the coil feeder 110, shearer 120, articulated robot 140, transferrer 150, press 160, discharger 170, guide actuator 183, and board centerer 184.

The memory 192 is connected with the central processing unit 191.

The memory 192 may be a computer-readable recording medium, installable locally or remotely, and may be at least one of, e.g., random access memories (RAMs), read-only memories (ROMs), floppy disks, hard disks, or any other various forms of digital storage.

The support circuit 193 may be coupled with the central processing unit 191 to support typical operations of the processor.

The support circuit 193 may include a cache, a power supply, a clock circuit, an input/output circuit, and a sub system.

According to an embodiment, the controller 190 may automatically control the operation of the coil feeder 110, shearer 120, articulated robot 140, transferrer 150, press 160, discharger 170, guide actuator 183, and board centerer 184, and such a series of processes may be stored in the memory 192.

For example, software routines may be stored in the memory 192.

The software routines may be stored or executed by other central processing unit (not shown).

Although the processes are described to be executed by software routines, at least some of the processes according to an embodiment may be performed by hardware.

As such, the processes according to an embodiment may be implemented in software executed on a computer system, in hardware, e.g., an integrated circuit (IC), or in a combination of software and hardware.

A method of transfer pressing for forming a car body part is described below.

A rolled coil is supplied to the processing line by rotation (S10). The supplied coil is cut into a board with a unit size by the shearer 120 (S20). The board is loaded on the loader 130 (S30). The loaded board is handled and supplied downstream, e.g., to the transferrer 150, by the articulated robot 140 (S40). The board moved by the transferrer 150 to the press 160 is press-processed (or formed) into a car body part by the press 160 (S50). Then, the formed car body part is discharged (S60). The transfer pressing apparatus and method for forming car body parts, according to embodiments, may automatically produce car body parts using rolled coils in a compact and more efficient manner, thus increasing working speed and productivity.

According to an embodiment, the apparatus is compact, thus significantly reducing space for installation and thus foot print. Further, unlike in the prior art, manual work may be significantly reduced, and working efficiency may be enhanced. Further, the tact time may be decreased.

Figure 4:
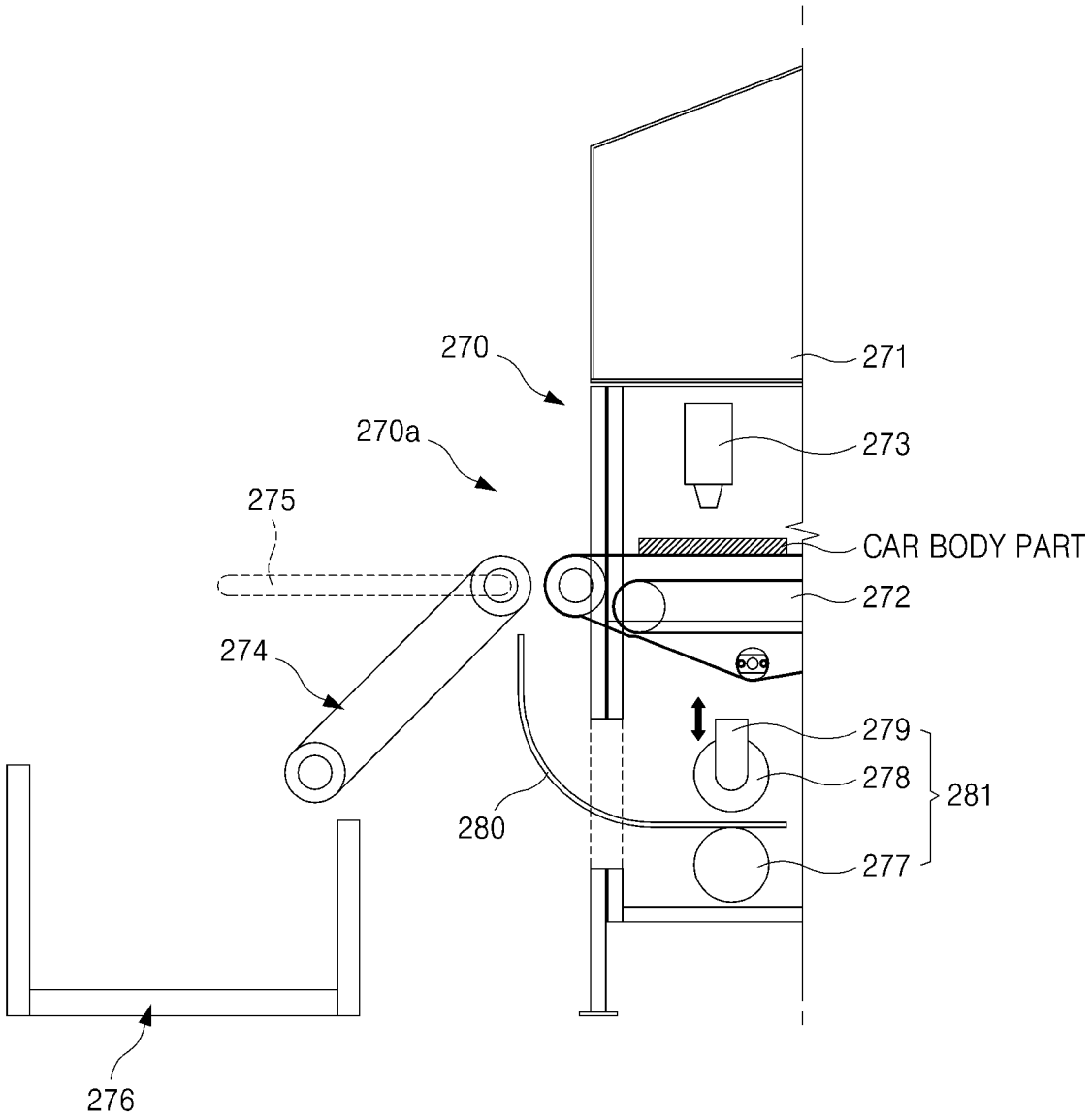
FIGS. 4 and 5 are views illustrating operations in an area of a discharger in a transfer pressing apparatus forming car body parts according to embodiments.
Figure 5:
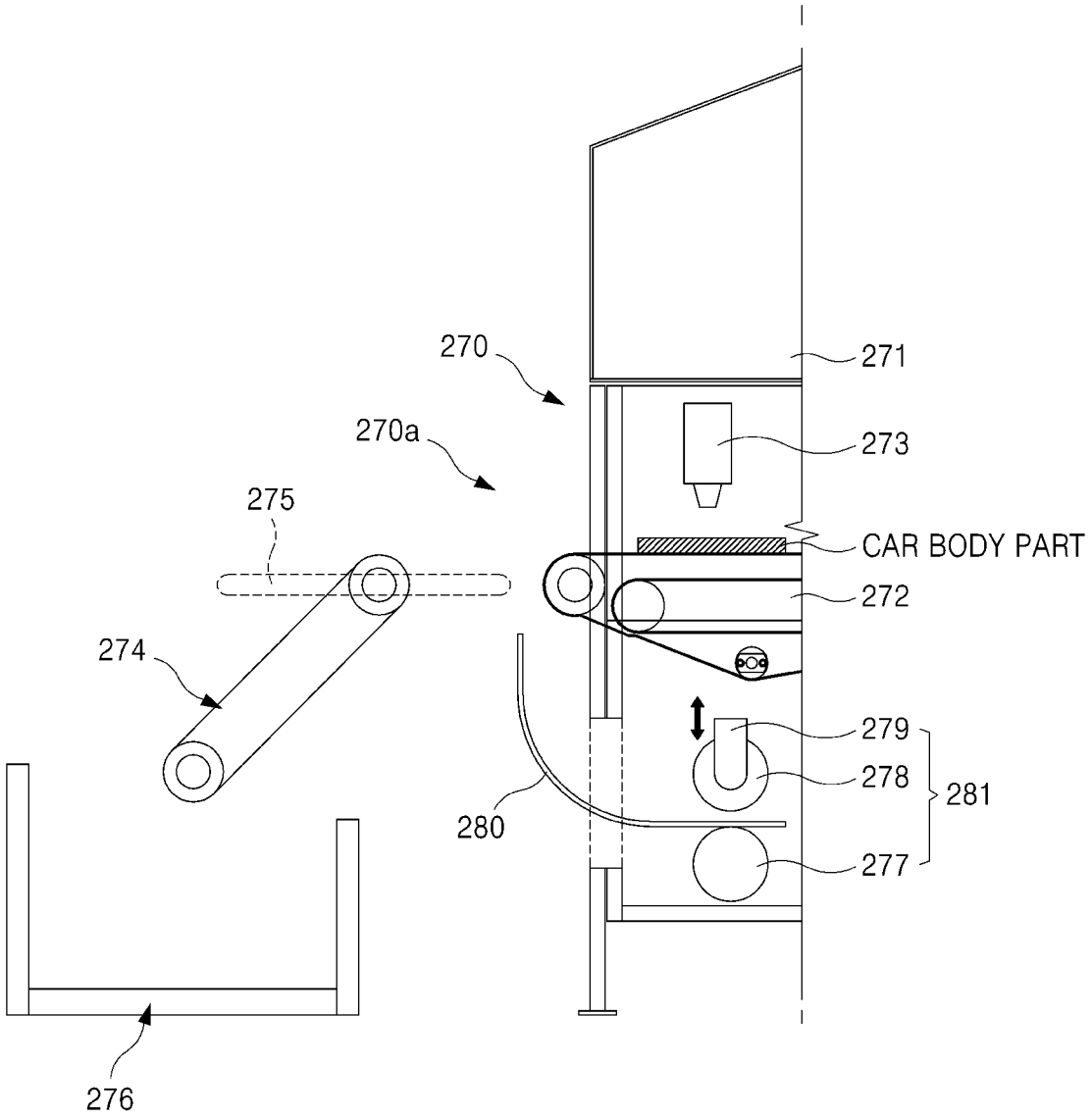

FIGS. 4 and 5 are views illustrating operations in an area of a discharger in a transfer pressing apparatus forming car body parts according to embodiments.

Referring to FIGS. 4 and 5, according to an embodiment, a discharger 270 of a transfer pressing apparatus for forming car body parts may include a post-processing device 270*a* that may collect the formed car body part if the car body part meets a predetermined quality while feeding back the car body part and flattening it to recycle as a flat plate or sheet if the car body part fails to meet the predetermined quality.

The post-processing device 270*a* may include a car body part discharging guide 274 disposed around a discharging conveyor 272 provided in the unit body 271 of the discharger 270 and approaching or moving away from the discharging conveyor 272 via a rail 275, a good-quality product container 276 provided in a lower area of the car body part discharging guide 274, a poor-quality product collecting guide 280 connected with one side of the unit body 271 to collect poor-quality products, a poor-quality product flattener 281 to press and flatten poor-quality products collected by the poor-quality product collecting guide 280, and a screening camera 273 provided on one side of the discharging conveyor 272 to screen good-quality and poor-quality products.

The two opposite side walls of the good-quality product loading container 276 may be formed with different heights to prevent interference with the operation of the car body part discharging guide 274.

For example, the side wall of the container 276 where the car body part discharging guide 274 is formed may be lower in height than the other side wall.

The poor-quality product flattener 281 may include a first and second pressing roller 277 and 278 and a roller driver 279 to move the first pressing roller 277 close to or away from the second pressing roller 278.

The operation of the post-processing device 270*a* with the above configuration is described below.

If the car body part discharged along the discharging conveyor 272 is determined to be of good quality by the screening camera 273, the car body part discharging guide 274 may be positioned as shown in FIG. 4, and thus, the good-quality car body part may be guided along the discharging conveyor 272 and the car body part discharging guide 274 and then be loaded in the good-quality product loading container 276.

In contrast, if the car body part discharged along the discharging conveyor 272 is determined to be of poor quality by the screening camera 273, the car body part discharging guide 274 is positioned as shown in FIG. 5.

Then, the car body part, i.e., the poor-quality product, discharged along the discharging conveyor 272 is dropped from the end of the discharging conveyor 272, is conveyed to the poor-quality product flattener 281 along the poor-quality product collecting guide 280, and is pressed and flattened between the first and second pressing rollers 277 and 278 of the poor-quality product flattener 281, and is then fed back upstream and recycled.

Figure 6:
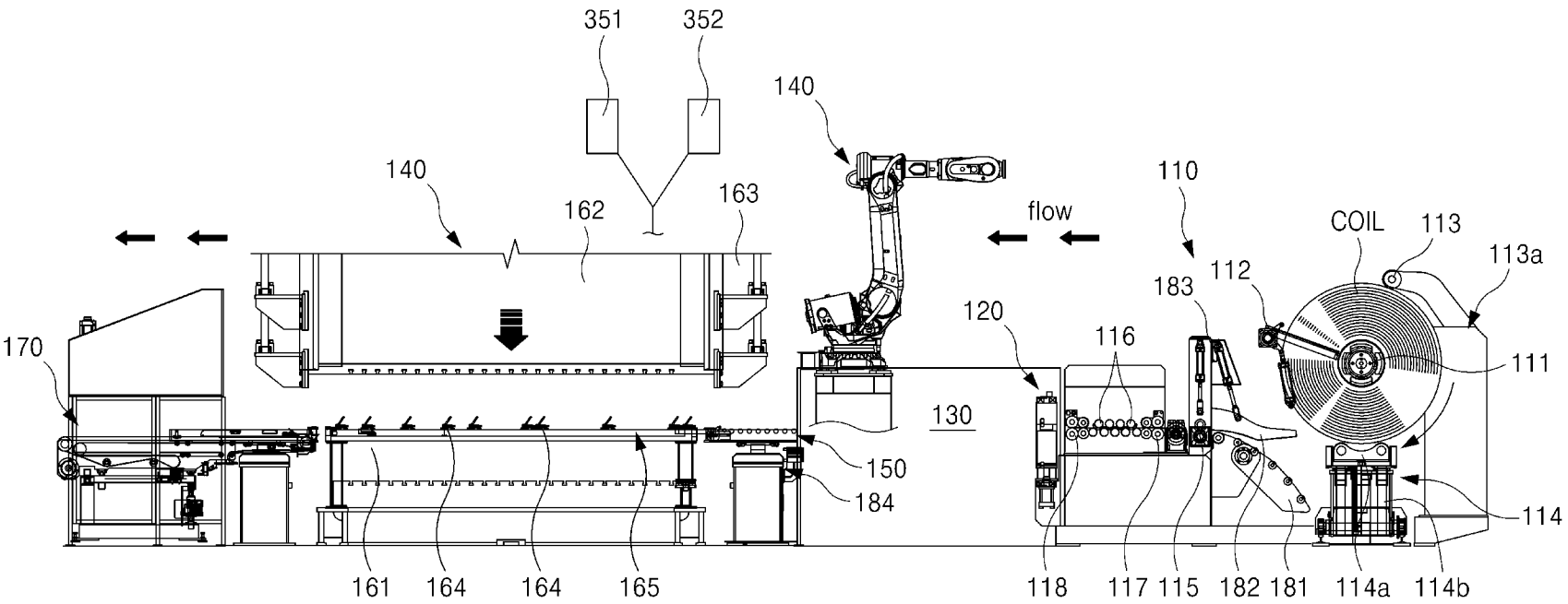
FIG. 6 is a view illustrating a configuration of a transfer pressing apparatus for forming car body parts according to an embodiment.
Figure 7:
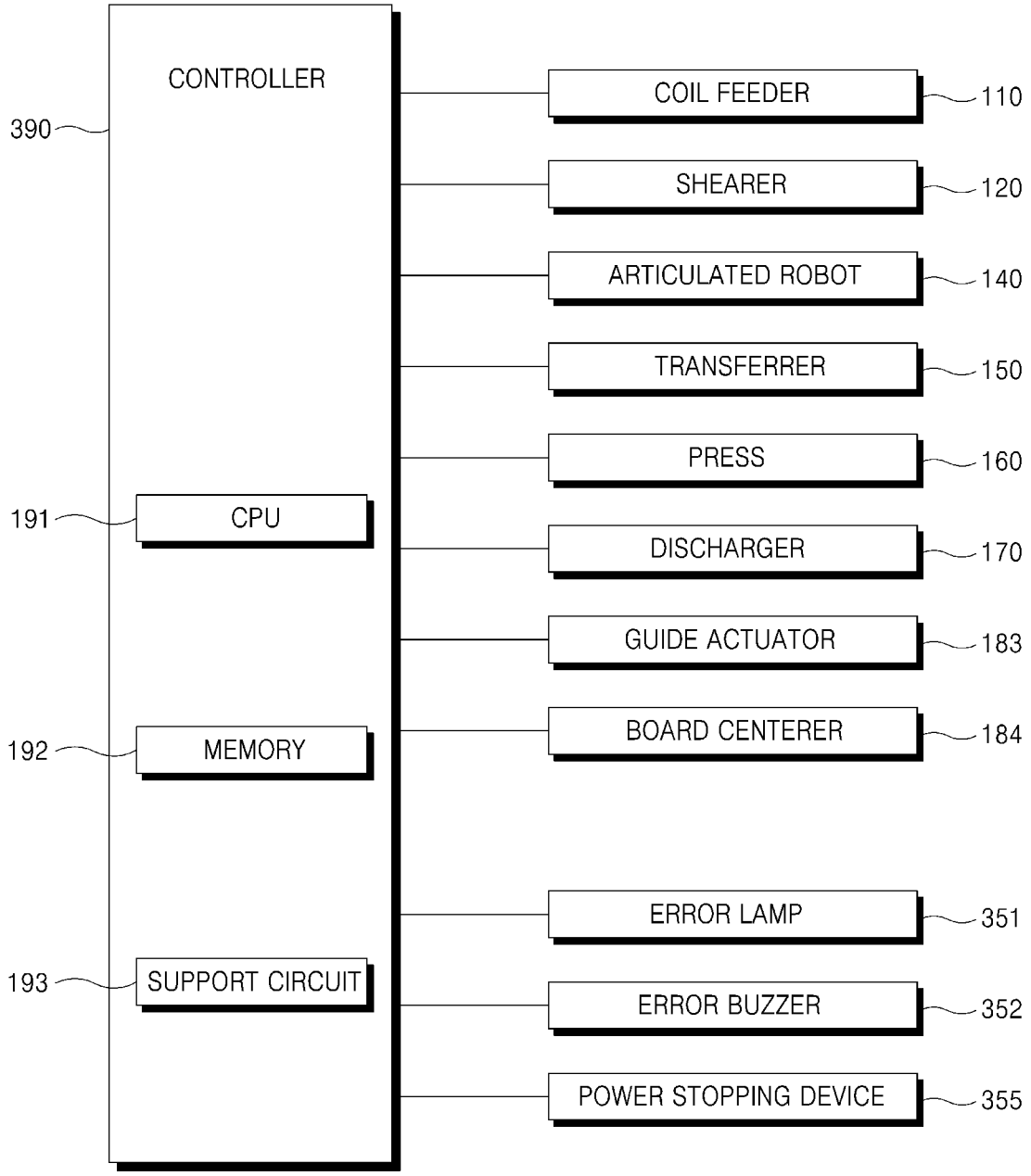
FIG. 7 is a block diagram illustrating a transfer pressing apparatus for forming car body parts as shown in FIG. 6.

FIG. 6 is a view illustrating a configuration of a transfer pressing apparatus for forming car body parts according to an embodiment. FIG. 7 is a block diagram illustrating a transfer pressing apparatus for forming car body parts as shown in FIG. 6.

Referring to FIGS. 6 and 7, the transfer pressing apparatus may have substantially the same structure as that described above.

According to an embodiment, the transfer pressing apparatus may further include an error lamp 351, an error buzzer 352, and a power stopping device 355.

The error lamp 351, the error buzzer 352, and the power stopping device 355 may be connected wiredly or wirelessly.

The error lamp 351 is a device controlled by the controller 390 to visually output an error in the process of transfer pressing for forming a car body part.

There may be one or more error lamps 351.

The error lamp 351 allows the worker to visually identify and handle errors in the process of transfer pressing for forming a car body part.

The error buzzer 352 is a device controlled by the controller 390 to be operated along with the error lamp 351 and to audibly output errors.

There may be one or more error buzzers 352.

The error buzzer 352 allows the worker to audibly identify and handle errors in the process of transfer pressing for forming a car body part.

According to an embodiment, the transfer pressing apparatus for forming car body parts may further include the power stopping device 355 operated in association with the controller 390 as described above.

The power stopping device 355 may be controlled by the controller 390 to cut off supply of power to the transfer pressing apparatus to stop the operation of the transfer pressing apparatus.

According to an embodiment, the controller 390 may simultaneously control the power stopping device 355 to automatically cut off power when controlling to provide a notification signal to the error lamp 351 and error buzzer 352.

Thus, unnecessary operations of the apparatus may be prevented.

Such a structure may also provide the effects described herein.

It is appreciated by one of ordinary skilled in the art that the scope of the disclosure is not limited to the embodiments set forth herein, and various changes or modifications may be made thereto without departing from the scope and spirit of the disclosure.

Thus, such changes or modifications also belong to the scope of the disclosure defined by the appended claims.

What is claimed is:

1. A transfer pressing apparatus for forming a car body part, comprising:

a coil feeder rotatably supporting a rolled coil and supplying the coil to a processing line by rotation; and a shearer disposed downstream of the coil feeder and cutting the coil supplied to the processing line into unit sizes, wherein the coil feeder includes:

a coil mount on which the coil is rotatably mounted;

a rotation driver connected with the coil mount and rotating the coil mount;

a guide arm disposed around the coil mount and guiding the coil released while rotating on the coil mount;

an arm driver driving the guide arm to allow the guide arm to contact the coil;

a coil exchanger including a coil loader for loading the coil and a forward/backward driver moving forward or backward the coil loader, the coil exchanger disposed around the coil mount, the coil exchanger moving close to or away from the coil mount while transferring the coil to the coil mount and exchanging the coil;

a coil mover disposed between the shearer and the coil mount and moving the coil released from the coil mount to the shearer;

a plurality of flattening rollers disposed between the coil mover and the shearer and flattening the coil;

a coil back end chuck disposed between the flattening rollers and the coil mover and chucking a back end of the coil; and a coil front end chuck disposed between the flattening rollers and the shearer and chucking a front end of the coil, wherein the coil feeder includes:

a fixed lower guide disposed between the coil mount and the coil mover and guiding the coil to the coil mover; and a rotational upper guide disposed over the fixed lower guide and, together with the fixed lower guide, guiding the coil, wherein the coil feeder includes:

a guide actuator connected with the rotational upper guide and rotationally driving the rotational upper guide; and a board centerer movably disposed around a transferrer and centering a board loaded on a base mold, and wherein transfer pressing apparatus further comprising:

a plurality of loaders on which a board cut into a unit size by the shearer are loaded;

an articulated robot disposed around the plurality of loaders and handling the board on the loaders; and the transferrer disposed adjacent to the articulated robot and supplying the board downstream.

2. The transfer pressing apparatus of claim 1, further comprising a press disposed downstream of the transferrer and pressing the board transferred by the transferrer into a car body part.

3. The transfer pressing apparatus of claim 2, wherein the press includes:

a base mold on which the board is placed;

a press mold disposed over the base mold;

a mold up/down driver connected with the press mold and moving up/down the press mold; and a moving aligning bar including a plurality of aligners disposed around the base mold to be movable to the base mold and aligning the board loaded on the base mold to a position for pressing.

4. The transfer pressing apparatus of claim 2, further comprising a discharger disposed downstream of the press and discharging the car body part.

5. The transfer pressing apparatus of claim 4, further comprising a controller configured to automatically control operations of the coil feeder, the shearer, the articulated robot, the transferrer, the press, the discharger, the guide actuator, and the board centerer.

6. The transfer pressing apparatus of claim 5, further comprising:

an error lamp controlled by the controller to visually output an error in a transfer pressing process for forming the car body part; and an error buzzer controlled to be operated along with the error lamp by the controller to audibly output the error.

7. The transfer pressing apparatus of claim 6, further comprising a power stopping device operated in association with the controller, wherein the controller controls the power stopping device to automatically stop power when controlling to provide a notification signal to the error lamp and the error buzzer.

* * * * *